US006672218B2

(12) United States Patent
Oechslin et al.

(10) Patent No.: US 6,672,218 B2
(45) Date of Patent: Jan. 6, 2004

(54) SELF-PROPELLING PROJECTILE HAVING A PENETRATOR CORE

(75) Inventors: Rolf Oechslin, Spiez (CH); Jürg Meister, Steffisburg (CH)

(73) Assignee: Ruag Munition, Thun (CH)

( * ) Notice: Subject to any disclaimer, the term of this patent is extended or adjusted under 35 U.S.C. 154(b) by 0 days.

(21) Appl. No.: 10/323,515

(22) Filed: Dec. 18, 2002

(65) Prior Publication Data

US 2003/0205160 A1 Nov. 6, 2003

Related U.S. Application Data

(63) Continuation of application No. PCT/CH01/00380, filed on Jun. 18, 2001.

(30) Foreign Application Priority Data

Jun. 19, 2000 (EP) ..... 00810536

(51) Int. Cl.[7] ..... F42B 12/06; F42B 12/50; F42B 12/20

(52) U.S. Cl. ..... 102/374; 334/367; 334/489; 334/502; 334/517; 334/518

(58) Field of Search ..... 102/334, 367–370, 102/372–374, 473, 489, 393, 502, 517–519

(56) References Cited

U.S. PATENT DOCUMENTS

| | | | | | |
|---|---|---|---|---|---|
| 904,255 | A | * | 11/1908 | Gathmann | 102/519 |
| 3,103,888 | A | * | 9/1963 | Rosenthal | 102/334 |
| 3,302,570 | A | | 2/1967 | Marquardt | |
| 3,935,817 | A | * | 2/1976 | Riparbelli | 102/517 |
| 4,075,946 | A | * | 2/1978 | Deffayet et al. | 102/518 |
| 5,131,329 | A | * | 7/1992 | Lips et al. | 102/364 |
| 5,189,248 | A | * | 2/1993 | Deffayet et al. | 102/374 |
| H1235 | H | * | 10/1993 | Canaday | 102/334 |
| 5,939,662 | A | * | 8/1999 | Bootes et al. | 102/473 |
| 6,145,441 | A | * | 11/2000 | Woodall et al. | 102/502 |
| 6,276,277 | B1 | * | 8/2001 | Schmacker | 102/384 |
| 6,393,992 | B1 | * | 5/2002 | Vasel et al. | 102/502 |
| 6,494,140 | B1 | * | 12/2002 | Webster | 102/374 |
| 2003/0047105 | A1 | * | 3/2003 | Vasel et al. | 102/502 |

FOREIGN PATENT DOCUMENTS

| | | |
|---|---|---|
| DE | 1900 604 | 10/1969 |
| FR | 1209 802 | 3/1960 |

OTHER PUBLICATIONS

Waffen Revue, Dec. 1972, No. 7. p. 1163, Journal Schwabisch Hall Verlag Schwerd GmbH.

Lenselink J, "Notes on small and medium caliber military cartridges—cartridges and projectiles in drawings and pictures", p. 26, 157 (1986) Delfia Press, Rijswijk, Netherlands (7, 92–94–01).

* cited by examiner

*Primary Examiner*—Harold J. Tudor
(74) *Attorney, Agent, or Firm*—Schweitzer Cornman Gross & Bondell LLP

(57) ABSTRACT

A self-propelling projectile allowing restricted local target effects comprises a penetrator core, a charge for at least partially fragmenting the core at a target, and autonomous ignition device for the charge. The penetrator core has a stepped tip with a forward exterior dart angle and a larger following acute angle and a dart shank that tapers towards a rear end of the core. A coaxial cavity is located within at least a rear portion of the core carries an active substance is next to an explosive charge for opening the cavity at the target. The active substance can either be of lethal or non-lethal characteristics. The projectile can be configured to be usable with conventional launchers and auxiliary equipment.

7 Claims, 3 Drawing Sheets

SELF-PROPELLING PROJECTILE HAVING A PENETRATOR CORE

The present application is a continution of PCT/CH01/00380 filed Jun. 18, 2001.

BACKGROUND OF THE INVENTION

The present invention relates to a self-propelling projectile within a penetrator core. In the case of so-called peace-keeping measures, it turns out that currently none of the multinational troops possesses suitable weapon systems. For example, a single sniper behind cover can at present be attacked only with heavy weapons if he has taken protective measures against tear gas and the like.

The tactical leaders of such offensives have therefore called for weapon systems that specifically penetrate bunker targets without totally wiping out the subject.

Tests by Denel (Pty) Ltd, Firgrove, Republic of South Africa, have shown that it is possible to shoot an explosive dart, also known as an explosive penetrator, through bunker targets such as concrete, light metal reinforced armouring and sand bags, even when the speed on impact on the target is below the speed of sound. It has also proved successful to fragment the explosive dart at the target, that is, behind the armouring, by means of its central explosive charge and to cause, relatively speaking, a great deal of destruction there.

The development of a special weapon system for heavy interventions by police (against bunker targets) is not financially justifiable, since the logistics as a whole of conventional combat troops would have to be modified at the same time.

The object of the present invention is therefore, to provide a dart-like projectile, especially an explosive dart, in such a way that an effect restricted locally to the target is achieved.

BRIEF DESCRIPTION OF THE INVENTION

In accordance with the foregoing, the present invention is a self-propelled projectile of the type typically having a launch velocity of less than 300 m/s having a penetrating core and a charge for at least partially fragmenting the core at the target.

The core is constructed with a stepped tip and has a coaxial cavity in which an active substance is located. An explosive charge is provided to open the cavity at the target.

The dart-like projectile is intended to pierce conventional walls of overground buildings, bullet-proof glass and also dugouts of reinforced concrete, light-armoured vehicles having panels of aluminium alloys, or barricades, especially of sandbags, and to put persons located behind them out of action or to render equipment inoperative.

The invention is able to utilize existing conventional weapon systems and/or concepts, and to be useable via their launching devices (platforms).

The invention is suitable both for interventions having a non-lethal and for those having a lethal outcome.

Surprisingly, the penetrator core pierces a bunker target and the like, without itself sustaining damage, so that active substances that have been made up for a pre-selected action can be introduced into the target area.

The invention can be embodied in a projectile having the same exterior ballistics as a hollow charge projectile or a large calibre explosive charge with a fragmentation jacket. This allows the use of existing weapon systems, and especially their existing platforms.

By simply replacing a warhead by a projectile jacket of similar exterior ballistics, a very specific effect can be achieved, without, for example, troop training and logistics having to undergo significant modification.

For police actions in particular, a non-lethal active substance is appropriate, which, for example, during raids or during instances of hostage taking, puts one or more persons temporarily out of action. Strong tear producing active substances such as tear gas or capsaicin can be introduced behind a target wall or bullet-proof glass.

Use of a fragment-forming penetration core produces a weapon that has a lethal action in a relatively large space. The formation of fragments is effected by known means.

A stepped tip which drops from a relatively large dart angle to a smaller angle allows the projectile to pass virtually intact through even heavily reinforced concrete walls, and has proved especially successful.

A taper of the dart shank is also advantageous, since this reduces frictional resistance during penetration.

By means of suitable notch-type grooves, such as in the axial direction, the penetrator core can be opened upon penetration with minimal force.

A mechanical connection between the penetrator core and a container for the non-lethal active substance can ensure automatic distribution thereof.

BRIEF DESCRIPTION OF THE DRAWINGS

A fuller understanding of the invention will be achieved upon consideration of the following description of exemplary embodiments of the subject matter of the invention, considered in association with the accompanying Figures, in which.

DETAILED DESCRIPTION OF THE INVENTION

Figure 1:
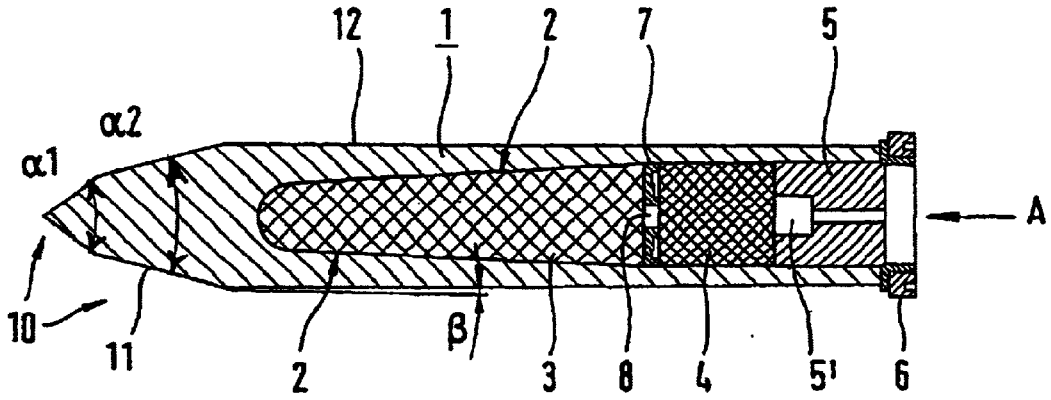
FIG. 1 shows, in sectional view, a penetrator core in accordance with the invention.

In FIG. 1, the reference numeral 1 denotes a dart-like penetrator core of the invention. It comprises a cavity 2, the side wall of which tapers towards its tip and there merges seamlessly into a spherical cap wall. An active charge 3, in this particular case a stabilised high-power explosive, is stored, free from voids, in the front-end part of the cavity 2. Behind the active charge 3 there is a compensating spring 7 having a central ignition channel 8. An initial charge 4, which together with a detonator 5' of an autonomous ignition device 5 forms an ignition chain known per se, is arranged behind the spring 7. At the rear of the penetrator core 1 there is a mounting flange 6, which permits easy integration of the core 1 with a propulsion means A, not shown. Notch-like grooves may be formed on the cavity wall to allow the core to more easily open to releave the active charge upon deformation.

The tip 10 of the penetrator core 1 is stepped towards the rear end. A relatively large dart angle a1 changes into a more acute angle a2 in an adjoining tapered shank region 11; the cylindrical dart shank 12 tapers inwardly by a small angle β towards its rear, which facilitates penetration of the dart at the target.

The form of a penetrator core 1 shown in FIG. 1 has a good penetration capacity, surprising even the expert, even in a velocity range of 160–240 m/s. The hard tip 10 having a dart angle a1, on which a characteristic energy of 50,000 joules acts, "clears away" most materials. There is no exact physical explanation for the phenomenal action of the penetrator core 1.

Figure 2:
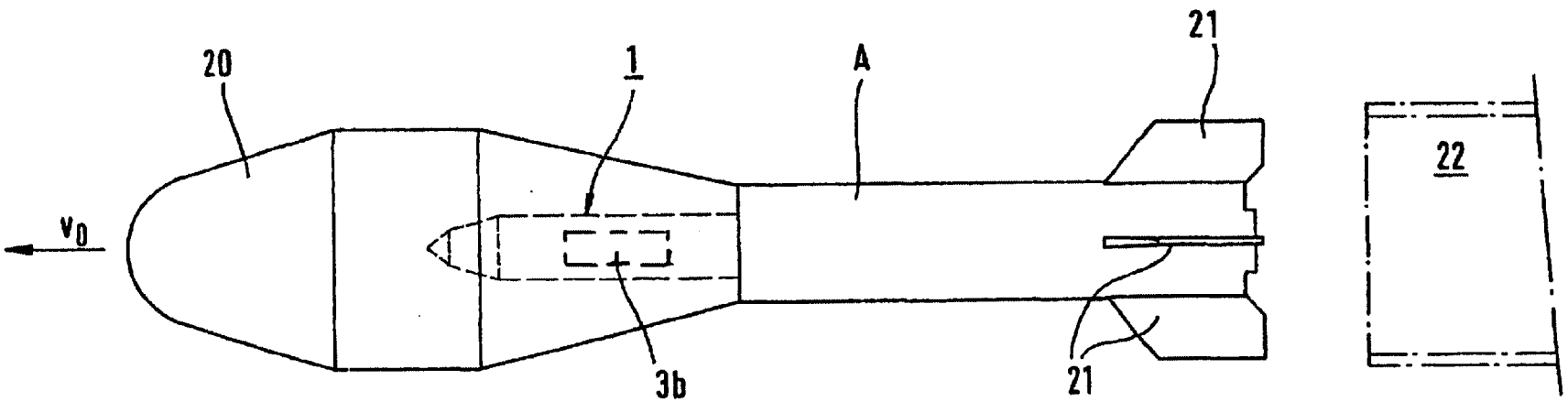
FIG. 2 shows a so-called bazooka projectile having an integrated penetrator core in accordance with the invention for non-lethal interventions.

FIG. 2 shows in simplified form a rocket in the characteristic form of a bazooka projectile to be launched from a barrel 22. The launch velocity $v_0$ amounts to a maximum of 300 m/s. The propulsion means A is of a conventional form, likewise the tail stabilizers 21. Unlike the conventional bazooka projectile, the penetrator core 1, which contains a non-lethal active substance 3*b*, is placed behind a two-part ballistic casing 20 on the propulsion means A.

Figure 3:
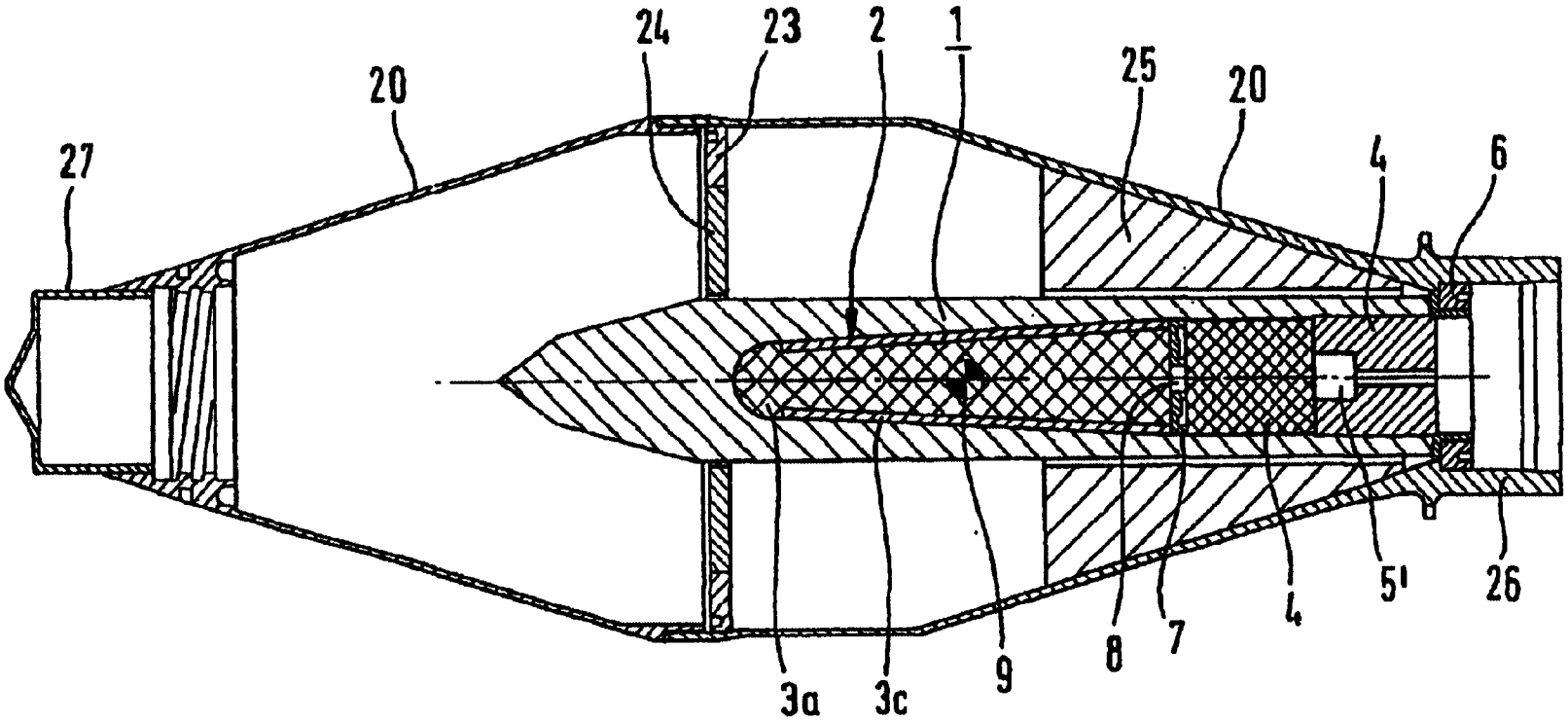
FIG. 3 shows, in sectional view, the ballistic casing of a bazooka projectile according to FIG. 2.

Further details of this construction are apparent from FIG. 3. In contrast to the illustration in FIG. 1, FIG. 3 relates to a purely lethally effective penetrator core 1. In the cavity 2 there is an explosive charge 3*a*, in which additionally a fragmentation ring 3*c* (fragmentation matrix) is incorporated; on detonation, the fragmentation ring, together with a fragmenting penetrator core 1, forms a plurality of fragments of different sizes.

The mounting flange 6 is here screwed with a positive fit into the casing 20. In the middle part of the casing 20 there is arranged a supporting ring 23, which merges into a centering ring 24 and symmetrically centers the penetrator core 1 axially. An additional weight 25, shifts the centre of gravity 9, shown symbolically, into the same position as in a conventional bazooka projectile. The further construction, such as the closure cap 27 (called a spike dummy) and the rear-end adapter 26 ensure a trouble-free attachment of the entire head to the propulsion means A. The resulting exterior ballistics are identical with those of a conventional bazooka projectile, which, as is well. known, contains a hollow charge.

Figure 4:
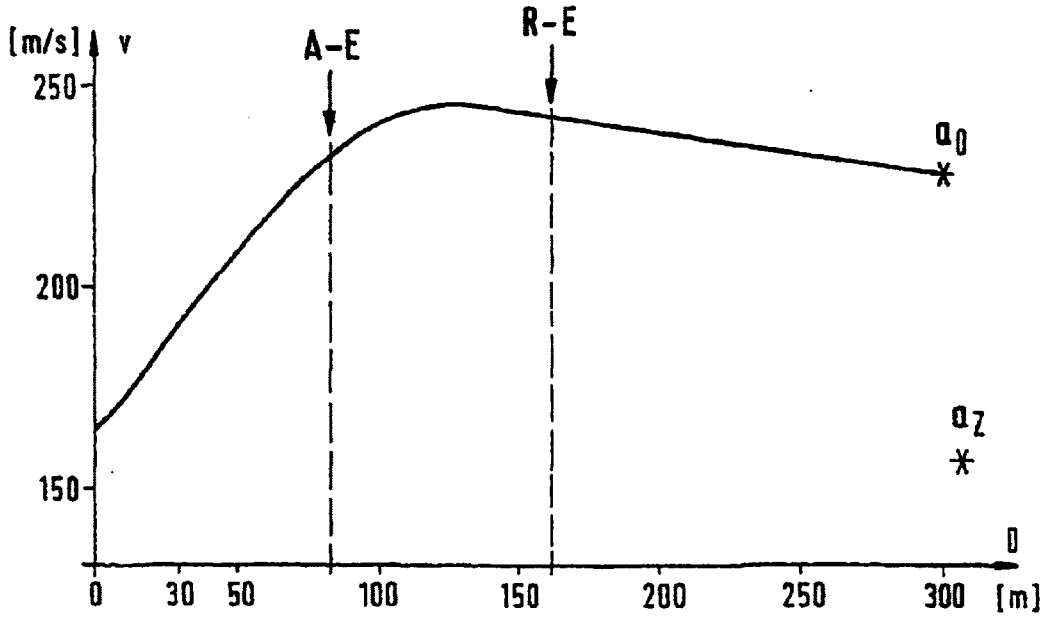
FIG. 4 shows a characteristic velocity profile of the bazooka projectile shown in FIG. 2 on its trajectory to the target.

FIG. 4 shows the velocity profile of a device according to the invention as a function of the trajectory (shot distance) D from launch to impact on the target $a_o$ and detonation $a_z$.

An ignition device is important for correct functioning and safety in use of the subject matter of the invention; from the secured state, via an acceleration-unlocking stage A-E and a retardation-unlocking stage R-E, the ignition device swings the detonator 5' into the armed position shown in FIGS. 1 and 3.

Suitable ignition devices having an integrated ignition generator, safety elements and a high-capacity detonator are commercially available (EMS-Patvag AG, CH-7013 Domat/Ems; type PEPZ-05). This igniter is intended to have a shock resistance of 100,000 g. The mode of operation of such igniters is described in detail in EP-A-0 104 138, in conjunction with U.S. Pat. No. 5,269,223. From these publications it can be deduced that the ignition devices can be adapted to virtually every use conceivable with the subject matter of the invention.

The penetrator core 1 is advantageously manufactured from an alloyed quenched and tempered steel according to DIN 34CrNiMo6 and is likewise commercially available (Gebr. Böhler & Co. AG, CH-8034 Wallisellen; type V155). In the preferred embodiment, the angle a1 is 70°; the angle a2 is 30° and the angle β (taper) is 1.4‰. For obvious reasons, the hardness profile of the penetrator core 1 is adjusted to decrease from the tip to the rear.

It has been shown that modern explosives (PBXN-9 of the firm DYNO Defence Products, NO) withstand the impact shock at target and yet require no additional pre-charge 4 for ignition.

The subject matter of: the invention allows a completely new manner of combating crime:

If, for example, a hostage-taker has barricaded himself in the service counter area of a bank, then by mobile radio-telephone determination (position fixing), a penetrator core 1 containing capsaicin 3*b* as the active charge can be shot towards the hostage-taker when no visual contact is available. A projectile suddenly piercing a wall or enclosure will paralyse him with fright, so that no resistance can be offered; within the next second the core 1 detonates; a relatively large amount of capsaicin is atomised and puts the hostage-taker completely out of action for a relatively long period of time, so that in parallel to this the police can enter the building unharmed and carry out their duty.

So that third parties are not endangered, when using non-lethal active charge substances such as tear gas, smoke, etc., only small amounts of explosive are incorporated in the cavity 2. By suitable notches in the inner wall, even slight centripetal forces are sufficient to cause the active charge substance to escape from a bursting penetrator core or to cause it to be atomised, especially when there is a mechanical connection (adhesion) between the active substance container and the penetrator core. Capsaicin, for example, may be in a plastic capsule mechanically connected to the cavity wall.

Depending on the ignition device, explosive charge of lethal or non-lethal active substances and additional active charges used, the individual and safe combating of targets of different danger potentials can be effected from a faraway range. The projectile and the penetrator core are accordingly of modular and exchangeable construction, and can be optimised in respect of collateral damage and threat. As a rule general rule, the result will be merely a hole of the size of the calibre of the penetrator core in the target or the wall to the pierced, so that the consequential structural damage resulting from such intervention is minimal.

We claim:

1. A self-propelling projectile, comprising: a penetrator core assembly and propulsion means for launching the penetrator core assembly at a maximum velocity of 300 m/s, the penetrator core assembly including a penetrator core a charge for at least partially fragmenting the core at a target, an autonomous ignition device for the charge, the penetrator core having a stepped tip with a forward dart angle and a smaller following acute angle and a dart shank that tapers inwardly towards a rear end of the core, and a coaxial cavity within at least a rear portion of the core in which a non-lethal active substance is located next to an explosive charge for opening the cavity at the target.

2. A self-propelling projectile, comprising: a penetrator core assembly and propulsion means for launching the penetrator core assembly at a maximum velocity of 300 m/s, the penetrator core assembly including a penetrator core, a charge for at least partially fragmenting the core at a target, and autonomous ignition device for the charge, the penetrator core having a stepped tip with a forward dart angle and a smaller following acute angle and a dart shank that tapers inwardly towards a rear end of the core, and a projectile jacket surrounding the penetrator core the core being aligned along a central axis of the projectile jacket, the penetrator core having a coaxial cavity having at least one explosive charge for opening the cavity at the target.

3. The self-propelling projectile according to claim 2 further comprising a non-lethal active substance located in the cavity.

4. The self-propelling projectile according to claim 1 or 3, charecterized in that the non-lethal active substance is capsaicin or tear gas.

5. The self-propelling projectile according to claim 1 or 2, wherein the penetrator core is fragment-forming.

6. The self-propelling projectile according to claim 1 or 2, wherein a fragment-forming ring is provided in the cavity.

7. The self-propelling projectile according to claim 1 or 3, wherein the non-lethal substance comprises a smoke-producing substance.

* * * * *